US008915717B2

(12) United States Patent
Stephan et al.

(10) Patent No.: US 8,915,717 B2
(45) Date of Patent: Dec. 23, 2014

(54) IMPELLER WHEEL FOR A VENTILATOR

(75) Inventors: Michael Stephan, Bretzfeld-Waldbach (DE); Ralf Neumeier, Waldenburg (DE); Volker Kress, Kupferzell (DE)

(73) Assignee: Ziehl-Abegg AG, Künzelsau (DE)

( * ) Notice: Subject to any disclaimer, the term of this patent is extended or adjusted under 35 U.S.C. 154(b) by 537 days.

(21) Appl. No.: 13/208,390

(22) Filed: Aug. 12, 2011

(65) Prior Publication Data

US 2012/0207606 A1 Aug. 16, 2012

(30) Foreign Application Priority Data

Aug. 13, 2010 (DE) ..... 10 2010 034 604

(51) Int. Cl.
*F04D 29/38* (2006.01)
*F04D 29/66* (2006.01)

(52) U.S. Cl.
CPC ..... *F04D 29/384* (2013.01); *F04D 29/666* (2013.01)
USPC ..... 416/228; 416/238; 416/243; 416/241 R; 416/189

(58) Field of Classification Search
CPC ... F04D 19/002; F04D 29/384; F04D 29/386; F05D 2250/712
USPC ..... 416/228, 237, 238, 214 R, 243, 189
See application file for complete search history.

(56) References Cited

U.S. PATENT DOCUMENTS

| | | | | | |
|---|---|---|---|---|---|
| 2,023,111 | A * | 12/1935 | Alsing | 416/144 |
| 4,063,852 | A * | 12/1977 | O'Connor | 416/228 |
| 4,089,618 | A * | 5/1978 | Patel | 416/228 |
| 4,664,593 | A | 5/1987 | Hayashi et al. | |
| 4,930,990 | A | 6/1990 | Brackett | |
| 5,181,830 | A * | 1/1993 | Chou | 416/223 R |
| 5,603,607 | A * | 2/1997 | Kondo et al. | 416/228 |
| 5,616,004 | A * | 4/1997 | Alizadeh | 416/238 |
| 6,024,537 | A | 2/2000 | Moreau et al. | |
| 6,416,288 | B1 * | 7/2002 | Song | 416/234 |
| 2002/0182071 | A1 | 12/2002 | Belady | |
| 2003/0123988 | A1 | 7/2003 | Wen | |
| 2006/0210397 | A1 | 9/2006 | Eimer | |
| 2008/0145230 | A1 * | 6/2008 | Harman et al. | 416/235 |

FOREIGN PATENT DOCUMENTS

| | | | |
|---|---|---|---|
| DE | 20 2004 005 548 | U1 | 7/2004 |
| EP | 1 484 510 | A1 | 12/2004 |
| GB | 2 050 530 | A | 1/1981 |
| JP | 2000/018194 | A | 1/2000 |
| JP | 2006/312912 | A | 11/2006 |
| WO | 2009/111958 | A1 | 9/2009 |

* cited by examiner

*Primary Examiner* — Ninh H Nguyen
(74) *Attorney, Agent, or Firm* — Gudrun E. Huckett

(57) ABSTRACT

The impeller wheel is rotatably supported about a central axis and has a hub on which vanes are arranged. The vane has across its radial length at least similar profiled sections, viewed in cylindrical section through the vane. The radial outermost profiled section which is positioned on a cylindrical enveloping surface of the impeller wheel has a greater displacement relative to the neighboring profiled section than this neighboring profiled section to its neighboring profiled section. The impeller wheel can also be provided on the radial outer edge with at least one projecting flow element whose axial height has a maximum in the area of the leading edge and of the trailing edge of the vane. The impeller wheels, while having a simple constructive configuration, provide a great noise reduction in operation of the ventilator.

20 Claims, 11 Drawing Sheets

IMPELLER WHEEL FOR A VENTILATOR

BACKGROUND OF THE INVENTION

The invention concerns an impeller wheel for a ventilator that is rotatably supported about a central axis and comprises a hub on which vanes are arranged The invention further relates to an impeller wheel for a ventilator, comprising a hub from which vanes are projecting that are provided with at least one projecting flow element at the radial outer edge.

Ventilators and impeller wheels are known (DE 20 2004 005 548 U1) in which vanes are projecting from the hub of the impeller wheel that are of a twisted configuration and are provided on the radial outer edge with flow elements. The vanes have approximately the cross-sectional shape of an airplane wing. The flow elements at the outer edge of these vanes have an analog extension. In this way, the outer edge of the flow elements extends approximately parallel to the cross-sectional topside and bottom side of the corresponding vane. In the area of the leading edge and trailing edge of the vanes the axial height of the flow elements decreases to almost 0. With such a configuration, a noise generation upon operation of the impeller wheel or the ventilator is to be at least reduced. The flow elements cause increased resistance for the leakage flow that flows about the radial outer edges of the vanes from the pressure side to the suction side.

The invention has the object to design an impeller wheel of the aforementioned kind in such a way that with a simple constructive configuration a high noise reduction in operation is achieved.

SUMMARY OF THE INVENTION

This object is solved in accordance with the invention in regard to the impeller wheel of the afore mentioned kind in that the vane about its radial length has at least similar profiled sections, viewed in cylindrical section through the vane, and in that the radial outermost profiled section that is positioned in a cylindrical enveloping surface of the impeller wheel has a greater displacement relative to the neighboring profiled section than this neighboring profiled section to its neighboring profiled section.

This object is further solved in accordance with the invention in regard to the impeller wheel of the afore mentioned kind in that the axial height of the flow element has a maximum in the area of the leading edge and the trailing edge of the vane.

In the impeller wheel according to the invention, the vane has across its radial length at least similar profiled sections, viewed in cylindrical section through the vane. The radial outermost profiled section that is positioned in the cylindrical enveloping surface of the impeller wheel is displaced relative to the neighboring profiled section. This displacement is greater than the displacement that this neighboring profiled section has to its neighboring profiled section. In this way, the vane is designed such that the vane, beginning at the hub of the impeller wheel, has across its radial length profiled sections that, at least across a portion of this radial length, are displaced relative to each other. The displacement in this area between the individual profiled sections is approximately identical. The radial outermost profiled section, however, is displaced by a value that is greater, preferably multiple times greater, than the displacement of the profiled sections in the aforementioned remaining radial area of the vane. In this way, the vane can be shaped in a constructively simple way such that the air can substantially flow past the radial outer profiled section without impairment, and a noise reduction is achieved in this way. The profiled section displacement at the radial outer edge of the vanes can be achieved in a simple way by the described shaping of the vane.

In this connection, the vane is designed such that across its radial length it has approximately similar profiled sections. The cross-sectional shapes of the vane are thus designed similarly so that even the radial outermost profiled section with respect to its cross-sectional shape does not differ significantly from the cross-sectional shapes of the other profiled sections in the longitudinal direction of the vane. As a result of the configuration in accordance with the present invention, the vane can be constructed in a very simple way because the profiled section of the vane is simply displaced, wherein displacement can be done by translatory and/or rotatory movement. This translatory and/or rotatory displacement of the profiled section enables a simple calculation and construction of the vane that, in this way, can be matched optimally to the application in question.

Advantageously, the profiled sections that follow the outermost profiled section at at least approximately identical spacings each have at least a displacement relative to each other that is smaller than the displacement between the outermost profiled section and the profiled section neighboring it.

Advantageously, the spacing of the profiled sections laid through the vane is greater than the radial width of the radial outermost profiled section of the vane that is formed by the displacement of the outermost profiled section. This end area has as a result of the greater displacement also a greater incline than the remaining part of the vane in which the other profiled sections, in particular the profiled section that is neighboring the outermost profiled section, are located.

The profiled sections that are following the outermost profiled section at at least approximately identical spacings each have at least partially a displacement relative to each other that is smaller than the displacement between the outermost profiled section and the profiled section neighboring it.

The spacing of the profiled sections is greater than the width of the end area, measured in radial direction, which width is formed by the displacement of the outermost profiled section, wherein the end area has a greater incline than the remaining part of the vane.

At least the outer profiled section of the vane is displaced translatorily and/or rotatorily relative to the neighboring profiled sections.

The radial outer profiled section has a different profile shape than the remaining profiled sections.

The leading edge of the vane across its length is at least partially concavely shaped.

The trailing edge of the vane across its length is at least partially convexly shaped.

The trailing edge of the vane is provided with teeth at least across a portion of its length.

The transition area between the leading edge and the radial outer edge of the vane in the rotational direction of the vane projects relative to the transition area where the leading edge passes into the hub.

The vane is embodied as a twisted vane.

The vane has a curved shape.

Also, the impeller wheel according to the invention is characterized in that the axial height of the flow element has a maximum in the area of the leading and trailing edges of the vane. Advantageously, the height of the flow element decreases in the direction toward the center of the vane. Because of this configuration of the flow element, an excellent noise reduction upon use of the impeller wheel as well as an optimal impairment-free flow of the air from the pressure side to the suction side are realized so that noise reduction is favorably affected.

In an advantageous configuration, the ratio of the axial height of the flow element to the axial thickness of the vane decreases from the maximum in the direction toward the center of the vane. The height of the flow element can decrease down to 0 in the area between the leading edge and the trailing edge of the vane.

The flow element together with the wall surrounding the impeller wheel forms a nozzle-shaped flow gap that connects the pressure side with the suction side of the impeller wheel and through which the air flows substantially unimpaired.

The flow element or the radial outer wall of the vane has a large inlet area at the pressure side.

The ratio of the axial height of the flow element to the axial thickness of the vane in the area of the flow element decreases beginning at and away from the leading edge and/or the trailing edge of the vane.

The leading edge of the vane across its length is at least partially concavely shaped.

The trailing edge of the vane across its length is at least partially convexly shaped.

The trailing edge of the vane is provided with teeth at least over a portion of its length.

The transition area between the leading edge and the radial outer edge of the vane is projecting in the rotational direction relative to the transition area between the leading edge and the hub.

The vane has a twisted shape.

The vane has a curved shape.

Further features of the invention result from the additional claims, the description, and the drawings.

BRIEF DESCRIPTION OF THE DRAWINGS

The invention will be explained in more detailed with the aid of several embodiments illustrated in the drawings.

DESCRIPTION OF PREFERRED EMBODIMENTS

Figure 1:
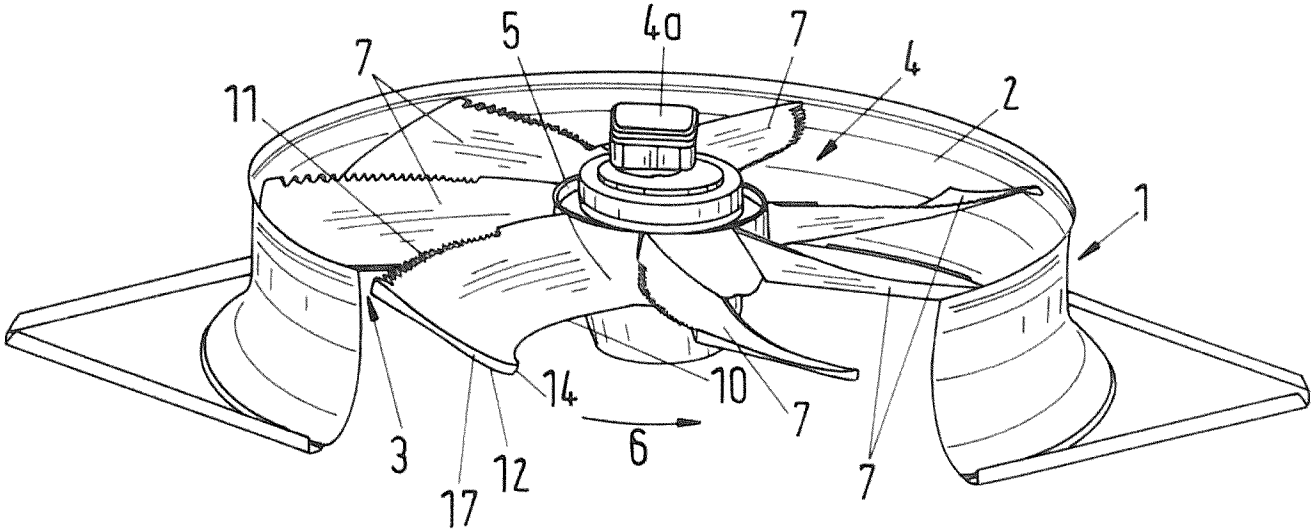
FIG. 1 shows in perspective illustration a part of a ventilator with an impeller wheel according to the invention.

The ventilator has a housing 1 with a cylindrical wall 2 that surrounds a conveying passage 3. In the conveying passage 3 the impeller wheel 4 is provided whose hub 5 is rotatably supported, as is known in the art. The impeller wheel 4 is rotatably driven in the direction of arrow 6 counterclockwise by means of a drive 4*a*.

Figure 6:
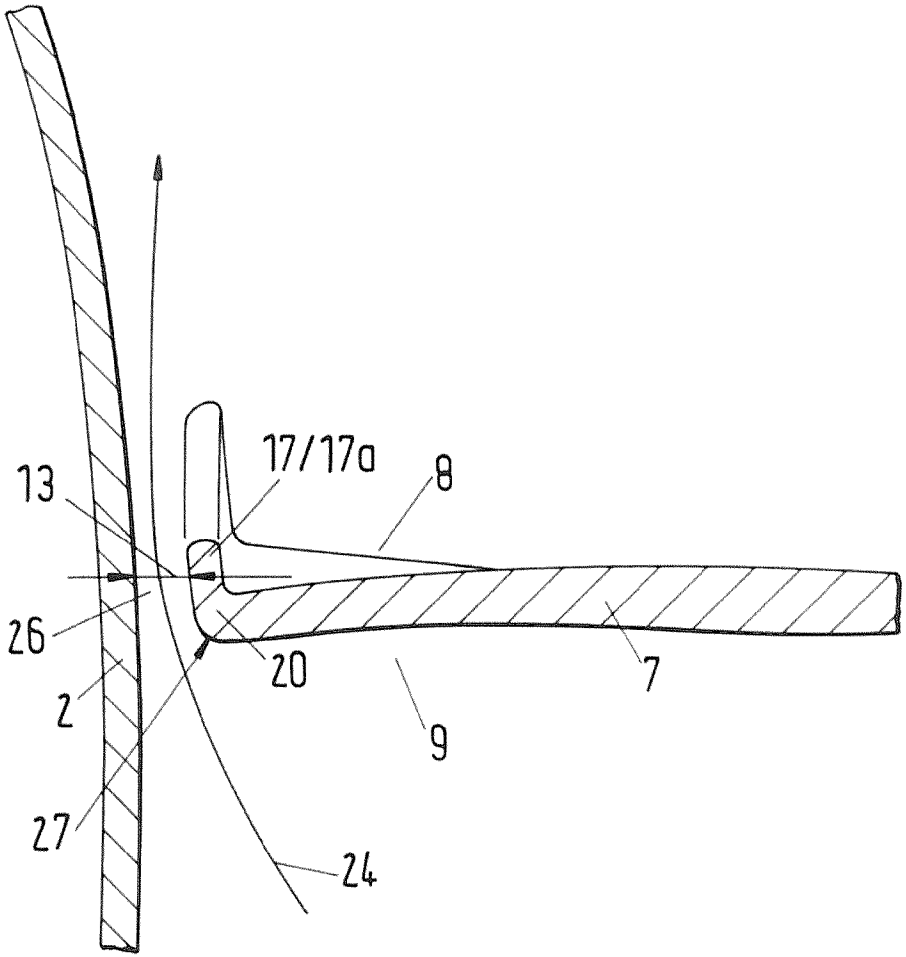
FIG. 6 shows in section view the flow course at a vane of an impeller wheel according to the invention.

Six vanes 7, for example, project form the hub 5 and extend into the vicinity of the wall 2. The air flows, as shown in FIG. 6, between the radial outer edge of the vanes 7 and the inner side of the wall 2 from the pressure side 9 substantially unimpaired to the suction side 8 of the impeller wheel 4.

In order for the noise developed in operation of the ventilator to be in a frequency spectrum that is pleasing to the human ear, it is advantageous when the vanes 7 are non-uniformly distributed about the circumference of the hub 5.

Of course, the impeller wheel 4 can also be designed such that the vanes 7 are uniformly distributed about the circumference of the hub 5.

The vanes 7 have each in rotational direction 6 a leading edge 10 at the front as well as a trailing edge 11 rearwardly positioned in the rotational direction 6. The leading edge 10, viewed in axial direction of the impeller wheel 4, is of a crescent shape, i.e., it has a concave extension. The leading edge 10 extends away from the hub 5 to the outer edge 12 that extends in the circumferential direction of the impeller wheel 4. The outer edge 12 has a radial spacing 13 (FIG. 6) from the housing wall 2. This spacing is selected such that the leakage flow is as small as possible and minimal noise is developed.

Figure 2:
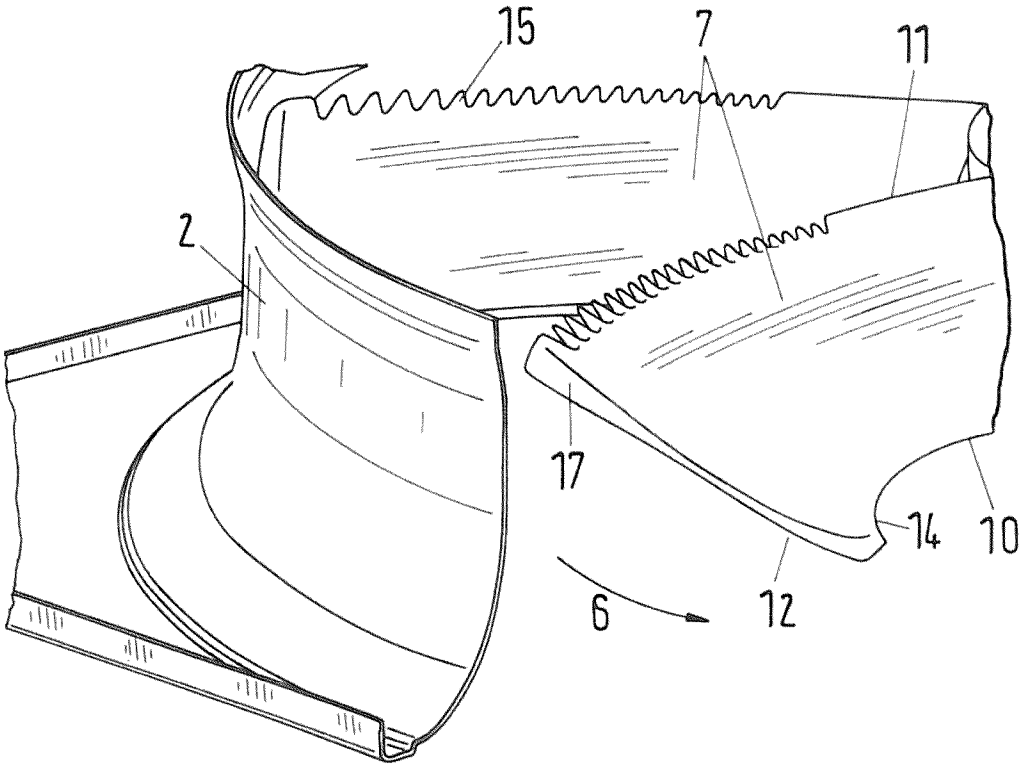
FIG. 2 is a detail illustration of a part of the ventilator according to FIG. 1.
Figure 3:
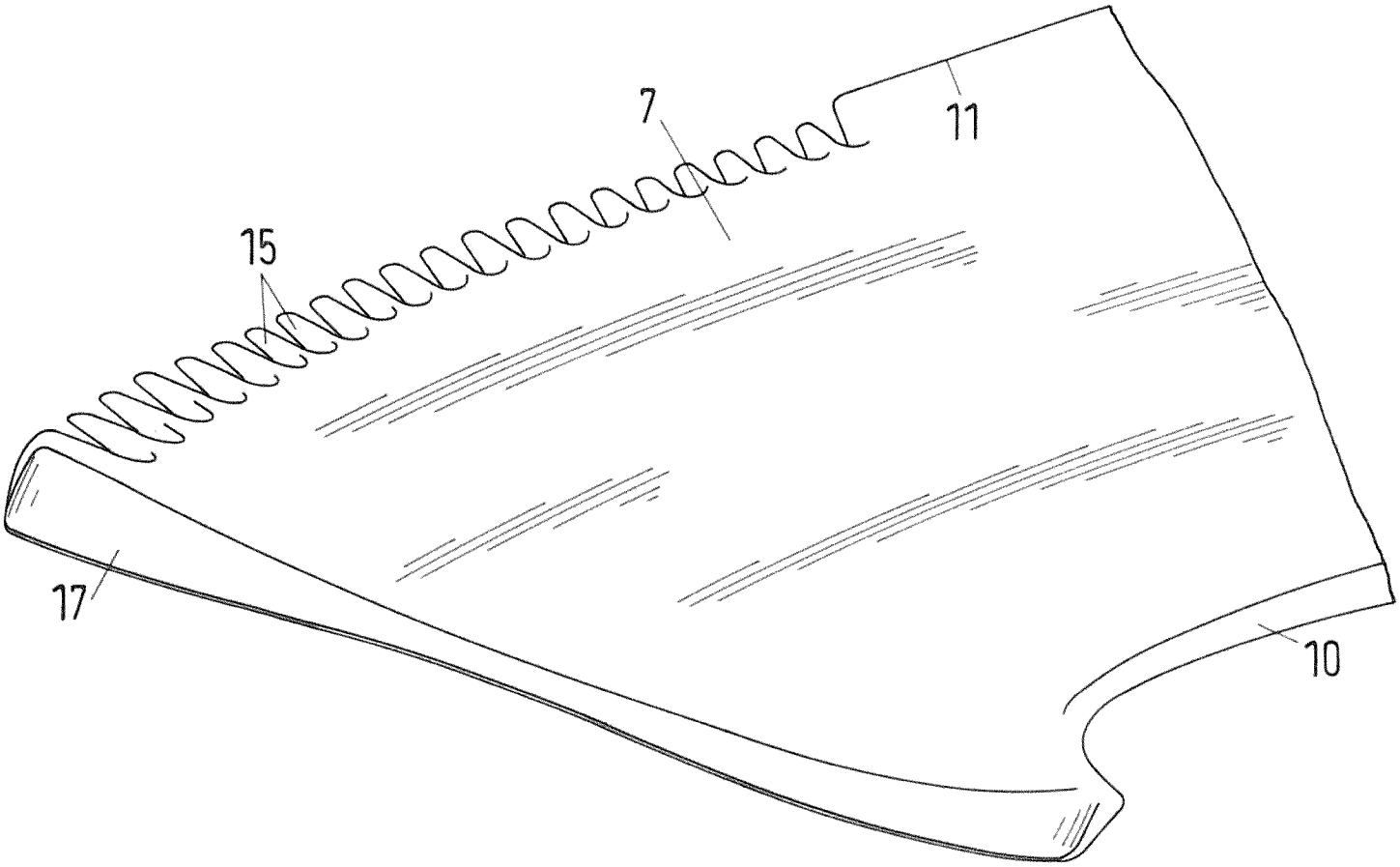
FIG. 3 shows in a perspective illustration the radial outer area of a vane of the impeller wheel according to the invention.

Advantageously, the area 14 (FIG. 2) where the leading edge 10 intercepts the outer edge 12, in rotational direction 6 of the impeller wheel 4, is positioned father forwardly than the connecting area of the leading edge 10 at the wall of the hub. When a radial line is drawn through the axis of the impeller wheel 4 and through this corner area 14, the connecting area of the leading edge 10 at the hub wall, viewed in axial direction, is behind this radial line in rotational direction. With such a configuration of the vanes 7 a noise reduction in operation of the ventilator and improvement of the separation behavior at the trailing edge is observed.

The trailing edge 11 of the vane 7 extends at least about a portion of its length in a convex shape. This convex shape can be provided from the hub 5 up to the outer edge 12 of the vane. However, it is also possible to provide the convex shape only about a portion of the length of the trailing edge 11 of the vane 7. For example, this convex course can be provided only in the area of the trailing edge 11 that adjoins the outer edge 12.

Figure 4:
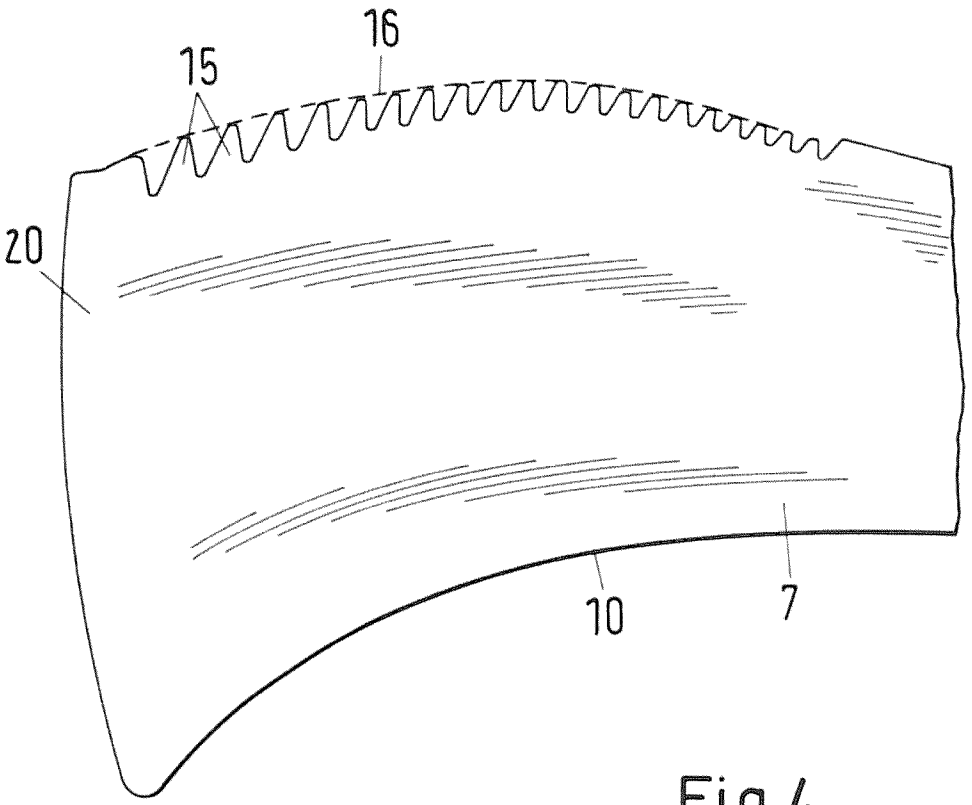
FIG. 4 is a plan view onto the vane according to FIG. 3.
Figure 7:
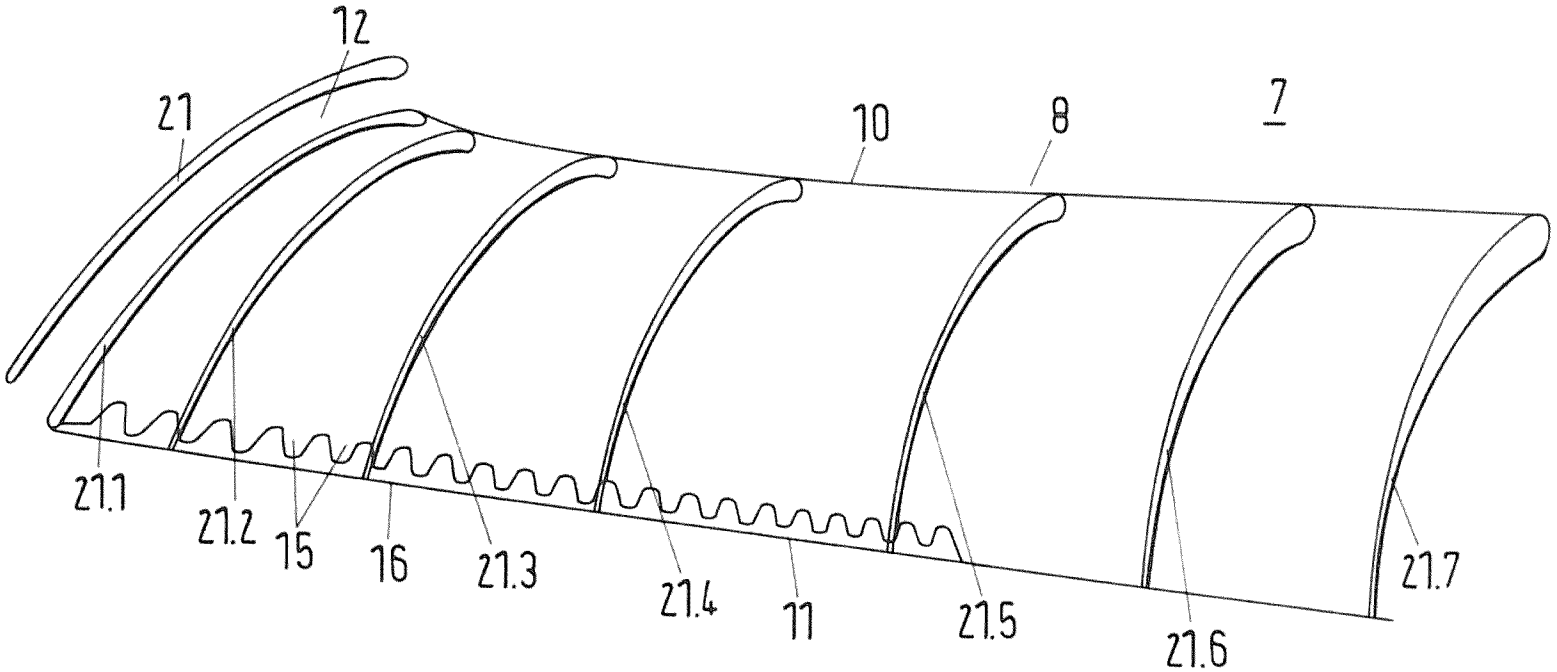
FIG. 7 is a perspective illustration of a second embodiment of a vane according to the invention with several sections.

In the illustrated embodiment the trailing edge 11 is provided about a portion of its length with teeth 15 that taper in the direction toward their free end. The teeth 15 can have identical contour shape. In a preferred embodiment, the teeth 15 are designed such that their ends that advantageously taper to a point extend up to a convexly extending enveloping line 16 (FIGS. 4 and 7). This enveloping line 16 can advantageously be a continuation of the area of the trailing edge 11 that is not provided with teeth.

The teeth 15 can have along the trailing edge 11 also different contour shapes and/or different length. With appropriate selection of the design of the teeth 15, the noise development of the ventilator can be optimally adjusted to the respective application.

The vanes 7 are configured as twisted vanes.

On the radial outer edge 12 each vane 7 in the embodiment according to FIGS. 1 to 6 is provided with a flow element 17 that extends advantageously about the entire length of the outer edge 12 between the leading edge 10 and the trailing edge 11. The flow elements extends on the outer edge 12 to the suction side 8 of the vane 7. However, it is also possible that the flow element 17 extends on the suction side 8 as well as on the pressure side 9. Also, it is possible that the flow element 17 is projecting only in the direction toward the pressure side 9.

The flow elements 17 are advantageously configured monolithically together with the vanes 7 but, in principle, can also be components separate from the vanes that are then attached in a suitable way to the vanes.

Figure 5:
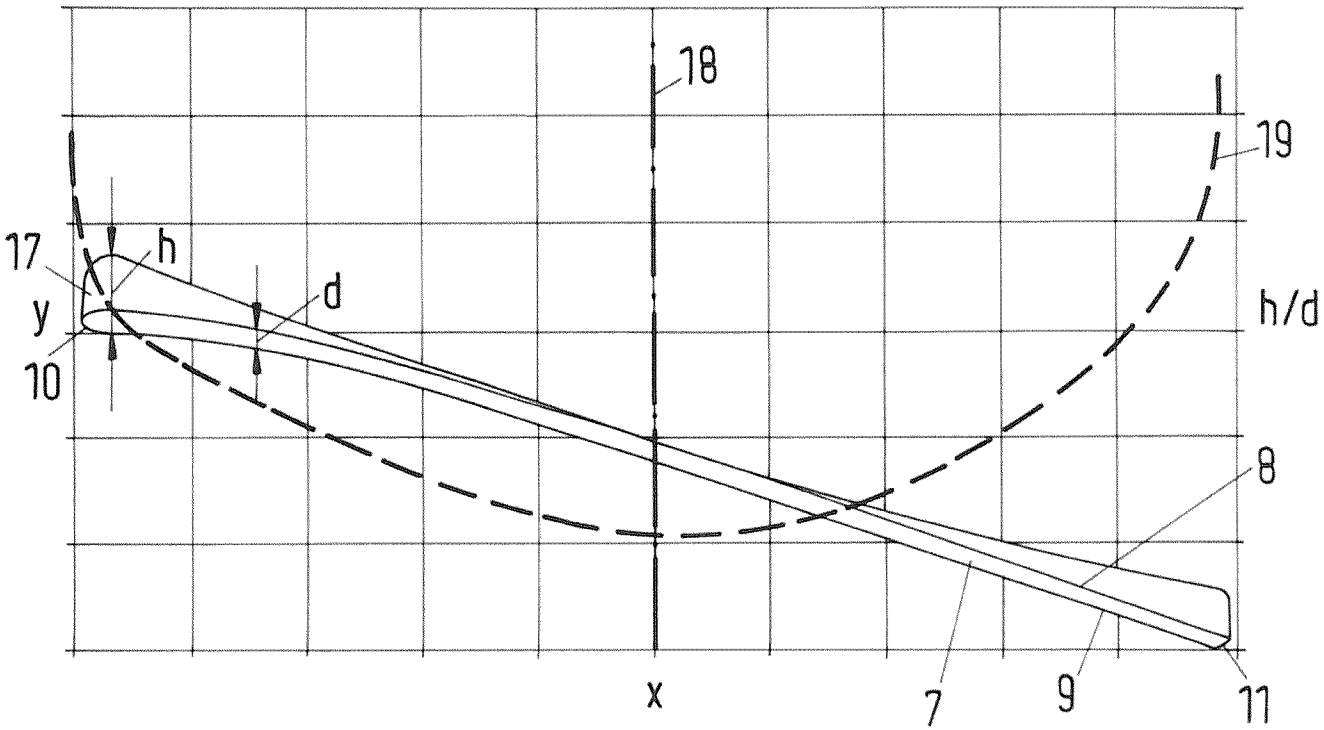
FIG. 5 shows in a diagram the cross-sectional course of the vane as well as of a flow element provided at the radial outer end of the vane as well as the ratio of the height of the flow element measured in axial direction of the ventilator relative to the thickness of the vane.

The flow element 17 has in the area of the leading and the trailing edges 10, 11 of the vane 7 its greatest height h, respectively, measured in axial direction 18 of the impeller wheel 4 (FIG. 5). In FIG. 5, the flow element 17 as well as the profile of the corresponding vane 7 are illustrated at the level of the flow element 17. The axial height h of the flow element 17 decreases beginning at and away from the leading edge 10 or the trailing edge 11, respectively, until the flow element 17 in the area between the two edges 10, 11 reaches the height 0 or approximately 0. This area can be located at half the width of the vane 7. The vane 7 has in the area of the flow element 17 the axial thickness d. In the remaining area the vane 7 can have a different axial thickness.

The axial height h of the flow element 17 as well as the axial thickness d of the vane 7 are matched to each other such that the ratio h/d decreases beginning at and away from the leading edge 10 as well as the trailing edge 11, as indicated by the dashed line 19 in FIG. 5. In the area in which the axial height h of the flow element 17 is approximately 0, this ratio h/d is at a minimum.

Depending on the application, the flow element 17 can also be designed such that its minimal axial height is not positioned at half the width of the vane 7. It is important that the indicated ratio h/d decreases away from the leading edge 10 or the trailing edge 11. With such a configuration of the vane with flow element an excellent noise reduction in use of the ventilator results.

As can be seen in FIG. 5, the vane 7 has an airplane wing profile shape. In the area of the leading edge 10, the vane 7 is rounded while in the area of the trailing edge 11 it tapers approximately to a point. In the area between the two edges 10, 11 the vane 7 can also have an approximately constant cross-sectional thickness.

In the preferred one-part configuration of vane 7 and flow element 17, the vane 7 has at the pressure side 9 a large inlet area 20 (FIG. 6) at the transition from the vane 7 to the flow element 17, preferably with a large radius 27. This excellently contributes to a noise-reduced operation of the ventilator.

The flow element 17 is designed such that its axial extension, beginning at the leading edge 10 of the vane 7, across a very short area increases strongly until the flow element has its greatest axial height h with minimal spacing relative to the leading edge 10. Similarly, the axial height h of the flow element 17 increases, beginning at the trailing edge 11 of the vane 7, across a very short area strongly until the flow element, with minimal spacing from the trailing edge 10 in this area, has its greatest axial height h that decreases in the direction of the center of the vane 7. As a result of this configuration the flow element 17 has a completely different course than the vane 7 in the area of the flow element 17.

FIGS. 7 to 11 show a twisted vane 7 which instead of the flow element 17 in the radial outer area has such a configuration that despite the missing flow element 17 the same effect is obtained as with the vane with flow element. This is achieved by a special configuration of the vane which will be explained in the following in more detail.

Figure 8:
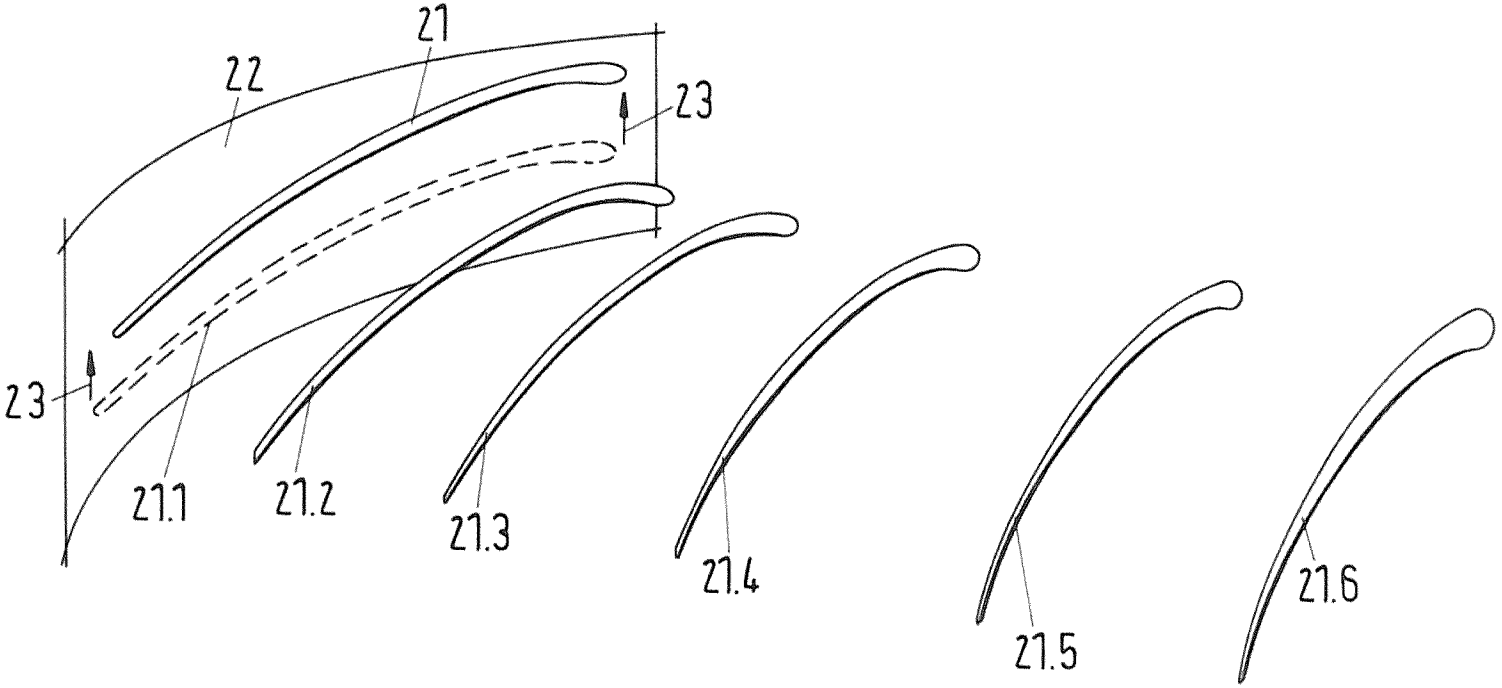
FIG. 8 shows the vane sections according to FIG. 7 with a cylindrical enveloping surface of the impeller wheel for explaining the displacement of the radial outer vane section.
Figure 9:
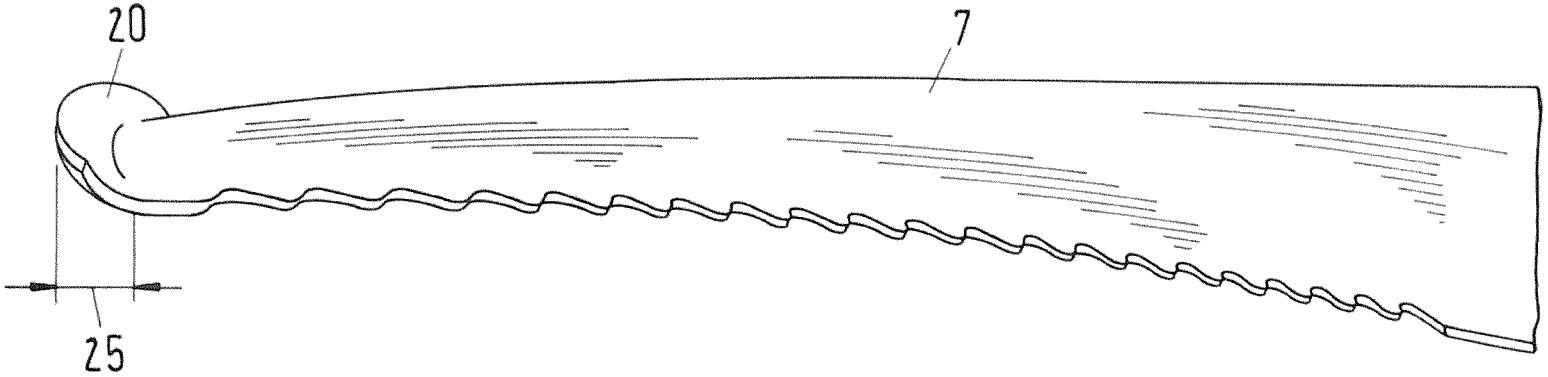
FIG. 9 shows in a perspective illustration the leading edge and the trailing edge and the end area formed by the displacement of the outer vane section of the vane according to FIG. 7.
Figure 10:
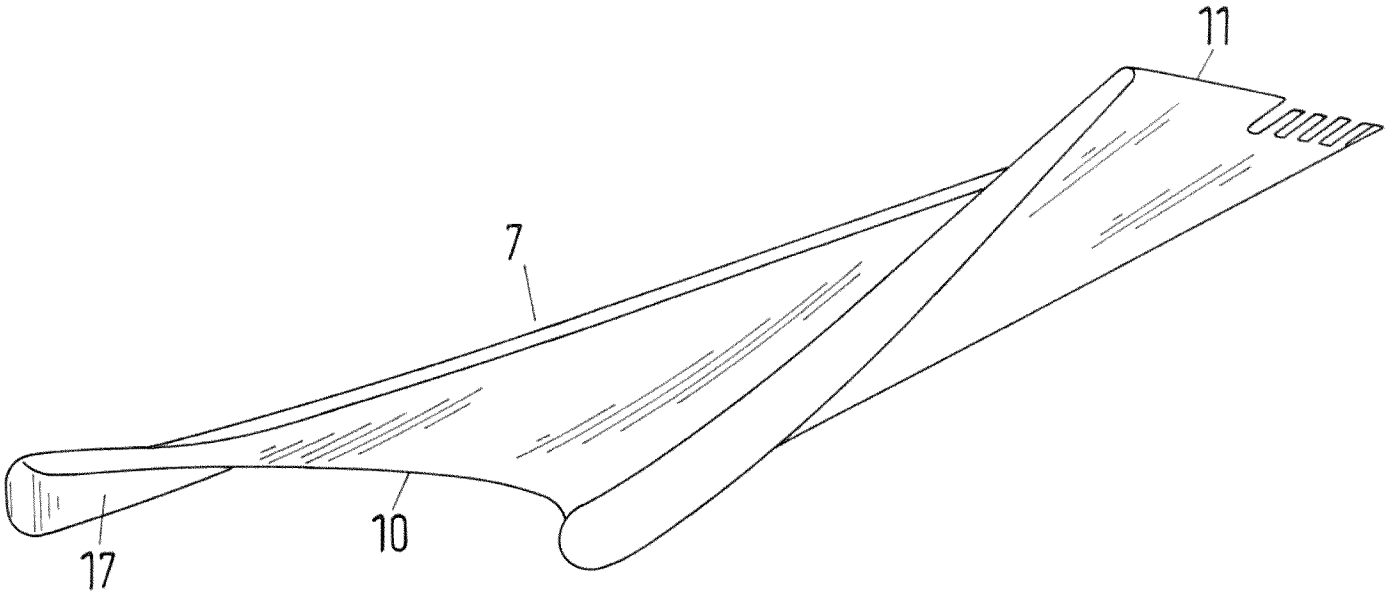
FIG. 10 shows in a perspective illustration the vane according to FIG. 3.

As shown in FIGS. 7 and 8, the vane 7 has about its radial length at the same spacings the profiled sections 24.1 to 24.7 that have a similar cross-sectional configuration. As in the preceding embodiment, the vane 7 has an airplane wing profile shape in which the vane 7 in the area of the leading edge 10 is rounded and in the area of the trailing edge 11 is tapering approximately to a point.

The outer edge 12 of the vane 7 facing the housing wall 2 is designed such that the radial outer profiled section of the vane is displaced in a direction toward the suction side 8. In FIG. 7, across the length of the vane 7 different profiled sections 21, 21.1, to 21.7 are indicated. The profiled sections are cylindrical sectional views of the vane 7. The profiled sections 21.1 to 21.7 are provided at the same spacings in radial direction of the vane 7. The profiled section 21.7 (FIG. 7) is provided at the hub 5 of the impeller wheel 4. It can be seen that all profiled sections 21 to 21.7 have a similar cross-sectional shape, in the embodiment an airplane wing profile shape. The profiled sections, beginning at the inner profiled section 21.7 and viewed in radial direction of the vane 7, are arranged so as to be displaced relative to each other.

In FIG. 8 the situation is illustrated that this displacement of the profiled sections up to the cylindrical enveloping surface 22 of the impeller wheel 4 is continued in the usual way. In this case, the radial outermost profiled section in the enveloping surface 22 would assume the position that is indicated in FIG. 8 by the dashed line 21.1. In the present embodiment, however, this radial outermost profiled section 21 is displaced in the direction toward the suction side 8 such that the profiled section 21 has a relatively large displacement relative to the neighboring profiled section 21.2. The displacement between this radial outermost profiled section 21 and the neighboring profiled section 21.2 is greater than the displacement between the profiled section 21.2 and the profiled section 21.3 neighboring it. As a result of this significant displacement between the outermost profiled section 21 and the neighboring profiled section 21.1 there is a radial outer end area 20 (FIG. 9) that has a substantially greater incline than the remaining part of the vane in which part the profiled sections 21.2 to 21.7 are located.

The profiled sections are designed such that the spacing of the profiled sections relative to each other is greater than the width 25 (FIG. 9) of the radial outer end area 20 that is formed by the displacement of the outermost profiled section 21. Since the displacement between the radial outermost profiled section 21 and the neighboring profiled section 21.2 is greater, preferably significantly greater, than the displacement between the profiled sections 21.2 and 21.3, the radial outer end area 20 has a greater incline than the remaining part of the vane 7 where the profiled sections 21.12 21.7 are extending.

Basically, it is sufficient when only the outermost profiled section 21 is displaced in the direction toward the suction side 8 relative to the neighboring profiled section or profiled sections.

The radial end area 20 (FIG. 9) that is resulting from the displacement of the profiled section or profiled sections generates an effect that is similar to that of the flow element 17 of the preceding embodiment and that is achieved by the profiled section displacement alone.

In the embodiment, the profiled sections 21 to 21.7 have a similar cross-sectional configuration. The radial outer profiled section 21 can have a different profiled section shape than the remaining profiled sections 21.2 to 21.6. Accordingly, by influencing the position of the respective profiled sections relative to each other, the vane 7 can be optimized optimally to the required application with regard to efficiency and/or noise reduction.

In the described and illustrated embodiment the displacement of the profiled section is realized in the direction toward the suction side 8. The displacement can however also be toward the pressure side 9.

In other respects, the vane 7 is of the same configuration as in the preceding embodiment.

In order to achieve a flow 24 through the gap as unhindered as possible in the area between the flow element 17 or the end area 20 and the inner side of the housing wall 2, the flow element 17 or the end area 20, viewed in the axial direction of the impeller wheel 4 (FIG. 4), has a great radius of curvature 27.

Optimal gap flow 24 is assisted in that the flow gap 26 (FIG. 6) between the flow element 17 or the end area 20 and the housing wall 2 is tapering from the pressure side 9 in the direction toward the suction side 8. The flow gap 26 is designed like a nozzle; this contributes to an unimpaired flow of the air for noise reduction through the flow gap 26.

Figure 11:
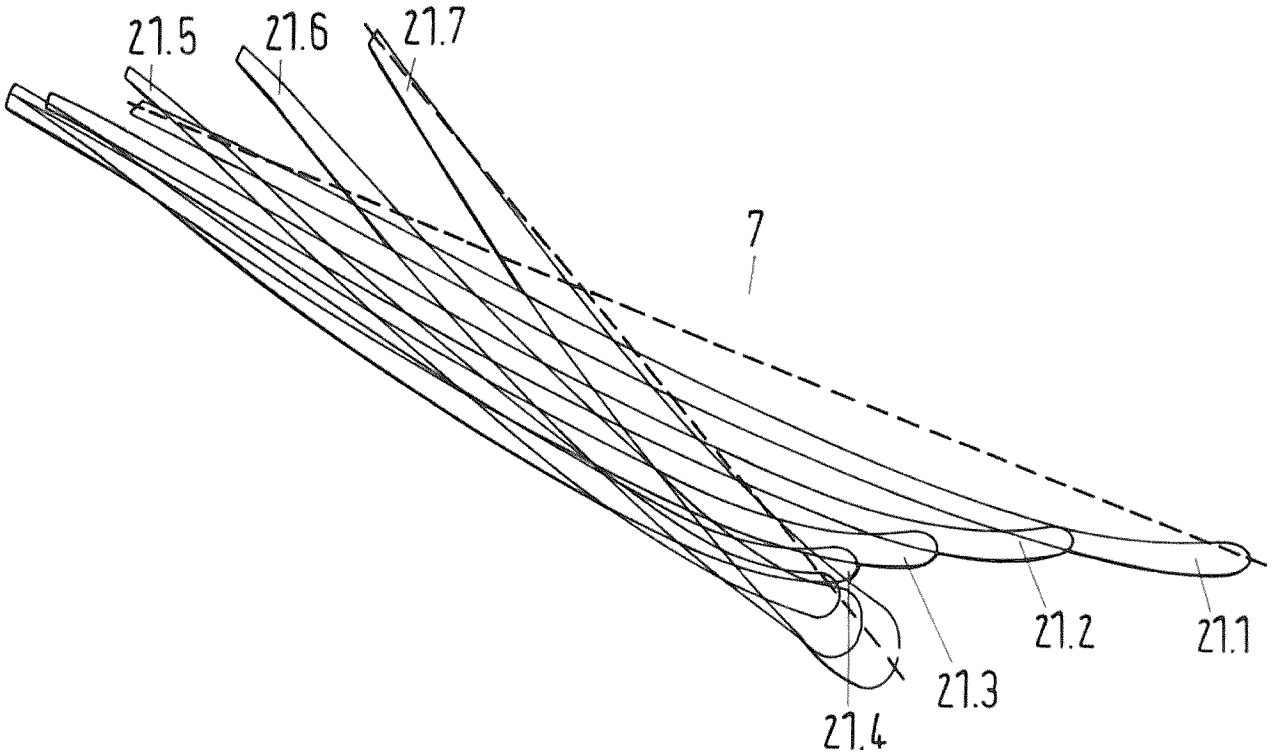
FIG. 11 shows several sections of the vane according to FIG. 10.

The displacement of the profiled sections of the vane 7 described in connection with the FIGS. 7 to 11 is realized in the illustrated embodiment by translatory and rotatory movement. In FIG. 11, the different profiled sections are illustrated in a projection onto the drawing plane. FIG. 11 shows that these profiled sections are not only displaced by translation but also by rotation relative to each other. It can be seen that the radial inwardly positioned profiled sections 21.7 to 21.5 extend steeper than the radial outwardly positioned profiled sections 21 to 21.4. FIG. 11 also shows that by this displacement of the profiled section across the radial length of the vane 7 the shape of this vane can be determined very simply by the designer and can be matched to the situation of use.

The specification incorporates by reference the entire disclosure of German priority document 10 2010 034 604.7 having a filing date of Aug. 13, 2010.

While specific embodiments of the invention have been shown and described in detail to illustrate the inventive principles, it will be understood that the invention may be embodied otherwise without departing from such principles.

What is claimed is:

1. An impeller wheel for a ventilator that is rotatably supported about a central axis, the impeller wheel comprising:

a hub;

vanes arranged on the hub and each having a radial length, wherein the vanes each have an airplane wing profile shape comprising a rounded leading edge and a trailing edge, wherein the vanes taper in accordance with the airplane wing profile shape from the rounded leading edge approximately to a point at the trailing edge;

wherein the vanes each have across the radial length a group of profiled sections, viewed in cylindrical section through the vane, that are at least similar to each other;

wherein a radial outermost profiled section of the group of profiled sections that is positioned in a cylindrical enveloping surface of the impeller wheel has a first displacement in an axial direction of the impeller wheel relative to a first profiled section of the group of profiled sections which first profiled section is neighboring the outermost profiled section inwardly in the radial direction;

wherein the first profiled section has a second displacement in the axial direction of the impeller wheel relative a second profiled section of the group of profiled sections that is neighboring the first profiled section inwardly in radial direction;

wherein the first displacement is greater than the second displacement for forming a radial outer end area of the vane that has a greater incline than the remaining part of the vane.

2. The impeller wheel according to claim 1, wherein sequentially arranged profiled sections of the group of profiled sections that are sequentially arranged in radial direction inwardly away from the outermost profiled section are at least approximately identically spaced at a spacing relative to each other and have at least partially a displacement relative to each other that is smaller than the first displacement.

3. The impeller wheel according to claim 2, wherein at least the outermost profiled section is displaced translatorily and/or rotatorily relative to the sequentially arranged profiled sections.

4. The impeller wheel according to claim 1, wherein a leading edge of the vane is at least partially concavely shaped across a length of the leading edge.

5. The impeller wheel according to claim 1, wherein a trailing edge of the vane is at least partially convexly shaped across a length of the trailing edge.

6. The impeller wheel according to claim 5, wherein the trailing edge of the vane is provided with teeth at least across a portion of the length of the trailing edge.

7. The impeller wheel according to claim 1, wherein a transition area between a leading edge of the vane and a radial outer edge of the vane in a rotational direction of the impeller wheel projects relative to a transition area where the leading edge passes into the hub.

8. The impeller wheel according to claim 1, wherein the vane is embodied as a twisted vane.

9. The impeller wheel according to claim 1, wherein the vane has a curved shape.

10. An impeller wheel for a ventilator that is rotatably supported about a central axis, the impeller wheel comprising:

a hub;

vanes arranged on the hub and each having a radial length;

wherein the vanes each have across the radial length a group of profiled sections, viewed in cylindrical section through the vane, that are at least similar to each other;

wherein a radial outermost profiled section of the group of profiled sections that is positioned in a cylindrical enveloping surface of the impeller wheel has a first displacement relative to a first profiled section of the group of profiled sections which first profiled section is neighboring the outermost profiled section inwardly in the radial direction;

wherein the first profiled section has a second displacement relative a second profiled section of the group of profiled sections that is neighboring the first profiled section inwardly in radial direction;

wherein the first displacement is greater than the second displacement;

wherein sequentially arranged profiled sections of the group of profiled sections that are sequentially arranged in radial direction inwardly away from the outermost profiled section are at least approximately identically spaced at a spacing relative to each other and have at least partially a displacement relative to each other that is smaller than the first displacement;

wherein the spacing is greater than a width of an end area of the vane, measured in radial direction, the width being formed by the displacement of the outermost profiled section, wherein the end area has a greater incline than a remaining part of the vane.

11. An impeller wheel for a ventilator, the impeller wheel comprising:

a hub;

vanes connected to the hub and projecting from the hub;

wherein the vanes each have a radial outer edge and at least one projecting flow element at the radial outer edge;

wherein the vanes each have a leading edge and a trailing edge;

wherein an axial height of the flow element has a maximum in the area of the leading edge and in the area of the trailing edge.

12. The impeller wheel according to claim 11, wherein the flow element together with a wall surrounding the impeller wheel forms a nozzle-shaped flow gap that connects a pressure side of the impeller wheel with a suction side of the impeller wheel, wherein air flows substantially unimpaired through the flow gap.

13. The impeller wheel according to claim 12, wherein the flow element or the radial outer edge of the vane has a large inlet area at the pressure side.

14. The impeller wheel according to claim 11, wherein a ratio of the axial height of the flow element to an axial thickness of the vane in the area of the flow element decreases beginning at and away from the leading edge and/or the trailing edge.

15. The impeller wheel according to claim 11, wherein the leading edge of the vane is at least partially concavely shaped across a length of the leading edge.

16. The Impeller wheel according to claim 11, wherein the trailing edge of the vane is at least partially convexly shaped across a length of the trailing edge.

17. The impeller wheel according to claim 16, wherein the trailing edge of the vane is provided with teeth at least over a portion of the length of the trailing edge.

18. The impeller wheel according to claim 11, wherein a transition area between the leading edge of the vane and the radial outer edge is projecting in the rotational direction relative to a transition area between the leading edge and the hub.

19. The impeller wheel according to claim 11, wherein the vanes have a twisted shape.

20. The impeller wheel according to claim 11, wherein the vanes have a curved shape.

* * * * *